US010753166B2

(12) United States Patent
O'Grady et al.

(10) Patent No.: US 10,753,166 B2
(45) Date of Patent: Aug. 25, 2020

(54) LOAD REDUCTION DEVICE AND METHOD FOR REDUCING LOAD ON POWER CABLE COILED TUBING

(71) Applicant: BAKER HUGHES, A GE COMPANY, LLC, Houston, TX (US)

(72) Inventors: Kenneth O'Grady, Collinsville, OK (US); John Mack, Catoosa, OK (US); Sean Cain, Tulsa, OK (US); James Christopher Clingman, Broken Arrow, OK (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 134 days.

(21) Appl. No.: 16/124,865

(22) Filed: Sep. 7, 2018

(65) Prior Publication Data

US 2019/0106955 A1 Apr. 11, 2019

Related U.S. Application Data

(60) Provisional application No. 62/569,139, filed on Oct. 6, 2017.

(51) Int. Cl.

| | |
|---|---|
| ***E21B 23/01*** | (2006.01) |
| ***E21B 17/20*** | (2006.01) |
| ***E21B 19/22*** | (2006.01) |
| *E21B 43/12* | (2006.01) |

(52) U.S. Cl.
CPC ..... *E21B 23/01* (2013.01); *E21B 17/206* (2013.01); *E21B 19/22* (2013.01); *E21B 43/128* (2013.01)

(58) Field of Classification Search
CPC ..... E21B 23/01; E21B 47/0007; E21B 43/128
See application file for complete search history.

(56) References Cited

U.S. PATENT DOCUMENTS

| | | | | |
|---|---|---|---|---|
| 2015/0136414 | A1* | 5/2015 | Hughes | E21B 43/128 166/372 |
| 2016/0258231 | A1* | 9/2016 | Naumann | E21B 17/003 |
| 2017/0241424 | A1 | 8/2017 | Patil et al. | |
| 2018/0232587 | A1 | 8/2018 | Wang et al. | |
| 2018/0320471 | A1 | 11/2018 | Jackson et al. | |

* cited by examiner

*Primary Examiner* — Cathleen R Hutchins
(74) *Attorney, Agent, or Firm* — Bracewell LLP; James E. Bradley

(57) ABSTRACT

A method for installing an electrical submersible pump (ESP) in a well containing a production conduit includes securing an ESP to a lower end of a coiled tubing segment containing an electrical power cable. An operator secures a load transfer device with a gripping member to the coiled tubing segment above the ESP. The operator lowers the coiled tubing segment into the well along with the ESP and the load transfer device. The load transfer device contacts an interior side wall of the production conduit with the gripping member and transfers a load on the coiled tubing segment to the production conduit. When powered, the ESP causes well fluid to flow upward from the ESP through the load transfer device up the production conduit.

4 Claims, 5 Drawing Sheets

LOAD REDUCTION DEVICE AND METHOD FOR REDUCING LOAD ON POWER CABLE COILED TUBING

CROSS-REFERENCE TO RELATED APPLICATION

This application claims priority to provisional application Ser. No. 62/569,139, filed Oct. 6, 2017.

FIELD OF INVENTION

The present disclosure relates to a power cable coiled tubing for supporting and supplying power to an electrical submersible pump. More particularly, the disclosure relates to a load transferring device that clamps around the power cable coiled tubing and frictionally engages the well production conduit to transfer at least part of the load on the power cable coiled tubing.

BACKGROUND

Electrical submersible well pumps (ESP) are often used to pump liquids from hydrocarbon producing wells. A typical ESP includes a pump driven by an electrical motor. Production tubing, which comprises pipes having threaded ends secured together, supports the ESP in most installations. The pump normally pumps well fluid into the production tubing. A power cable extends alongside the production tubing to the motor for supplying power. Installing and retrieving the ESP requires a workover rig to pull the production tubing.

In other installations, coiled tubing supports the ESP. The coiled tubing comprises a continuous length or segment of steel tubing that can be wound on a large reel at the surface before deploying and after retrieving. A power cable with power conductors for supplying power to the motor extends through the coiled tubing. The pump discharges well fluid up the annulus surrounding the coiled tubing. A coiled tubing installation allows the ESP to be installed and retrieved without the need for a workover rig.

Some wells are too deep for a conventional reel of coiled tubing containing a power cable. The weight of the coiled tubing with the power cable can cause the coiled tubing and power cable to part.

SUMMARY

A method for installing an ESP in a well containing a production conduit includes securing an ESP to a lower end of a coiled tubing segment containing an electrical power cable. The operator secures a load transfer device to the coiled tubing segment above the ESP. The operator then lowers the coiled tubing segment into the well along with the ESP and the load transfer device. The load transfer device has a gripping member that contacts an interior side wall of the production conduit and transfers a load on the coiled tubing segment to the production conduit. Powering the ESP causes well fluid to flow upward from the ESP through the load transfer device and up the production conduit.

Securing the load transfer device to the coiled tubing segment may comprise clamping the load transfer device to the coiled tubing segment.

In a first embodiment, contacting the interior side wall of the production conduit with the gripping member occurs continuously while simultaneously lowering the coiled tubing segment, the ESP, and the load transfer device into the well. In that embodiment, the gripping member rolls down the interior side wall of the production conduit while simultaneously lowering the coiled tubing segment into the well. Applying a brake to the gripping member imparts resistance to rolling and transfers part of the load on the coiled tubing to the production conduit.

In the first embodiment, the method further comprises securing an upper end of the coiled tubing segment to a wellhead at an upper end of the well.

In a second embodiment, the load transfer devices transfers the load only after the ESP has reached a selected depth. In that embodiment, a running string attaches to the load device to lower the coiled tubing segment and the ESP into the production conduit. After reaching a selected depth, the running string releases from the load transfer device and is retrieved. Then the operator lowers an upper power cable coiled tubing segment into the production conduit and electrically engages power conductors in the upper power cable coiled tubing segment with the power cable in the lower power cable coiled tubing segment.

An apparatus for pumping well fluid up a well comprises an ESP, a coiled tubing segment having a power cable therein and a lower end secured to the ESP, and a load transfer device. The load transfer device has a body having a longitudinal axis and a concentric bore extending upward from a lower end of the body into which the coiled tubing segment extends. A clamping arrangement secures the coiled tubing segment to the body above the ESP. At least one gripping member protrudes from the body for gripping an interior wall surface of a well conduit. At least one continuously open well fluid passage in the load transfer device extends from a lower end to an upper end of the body.

The clamping arrangement may comprise a collet with fingers that is positioned around the coiled tubing segment. A compression nut mates with the collet and deflects the fingers inward into frictional engagement with the coiled tubing segment. The continuously open well passage comprises a plurality of channels formed on an exterior of the body.

In the first embodiment, the coiled tubing segment extends through the bore and has an upper end configured to be secured to a wellhead at an upper end of the well. In that embodiment, the gripping member may comprise a plurality of rotatable tracks spaced circumferentially apart from each other around the body. A brake applies a resistance to the rotation of each of the tracks.

In the second embodiment, the gripping member may comprise a plurality of pads spaced circumferentially around the body. The load transfer device has means for urging the pads outward into frictional static engagement with the well conduit.

In the second embodiment, the coiled tubing segment has an upper end at the load transfer device and may be considered to be a lower coiled tubing segment. A lower set of electrical contacts within the bore is electrically connected with the power cable in the lower coiled tubing segment. The load transfer device has means for releasably securing a running string to the body, enabling the lower coiled tubing segment to be lowered into the production conduit on the running string until reaching a selected depth, then for releasing the running string from the body and retrieving the running string after the gripping member is engaging the production conduit.

An upper power cable coiled tubing segment is then deployed into the well and into engagement with the body after the running string has been retrieved. An upper set of electrical contacts on a lower end of the upper power cable coiled tubing segment electrically connect with the lower set of electrical contacts after the upper power cable coiled tubing segment engages the body.

DETAILED DESCRIPTION

Figure 1:
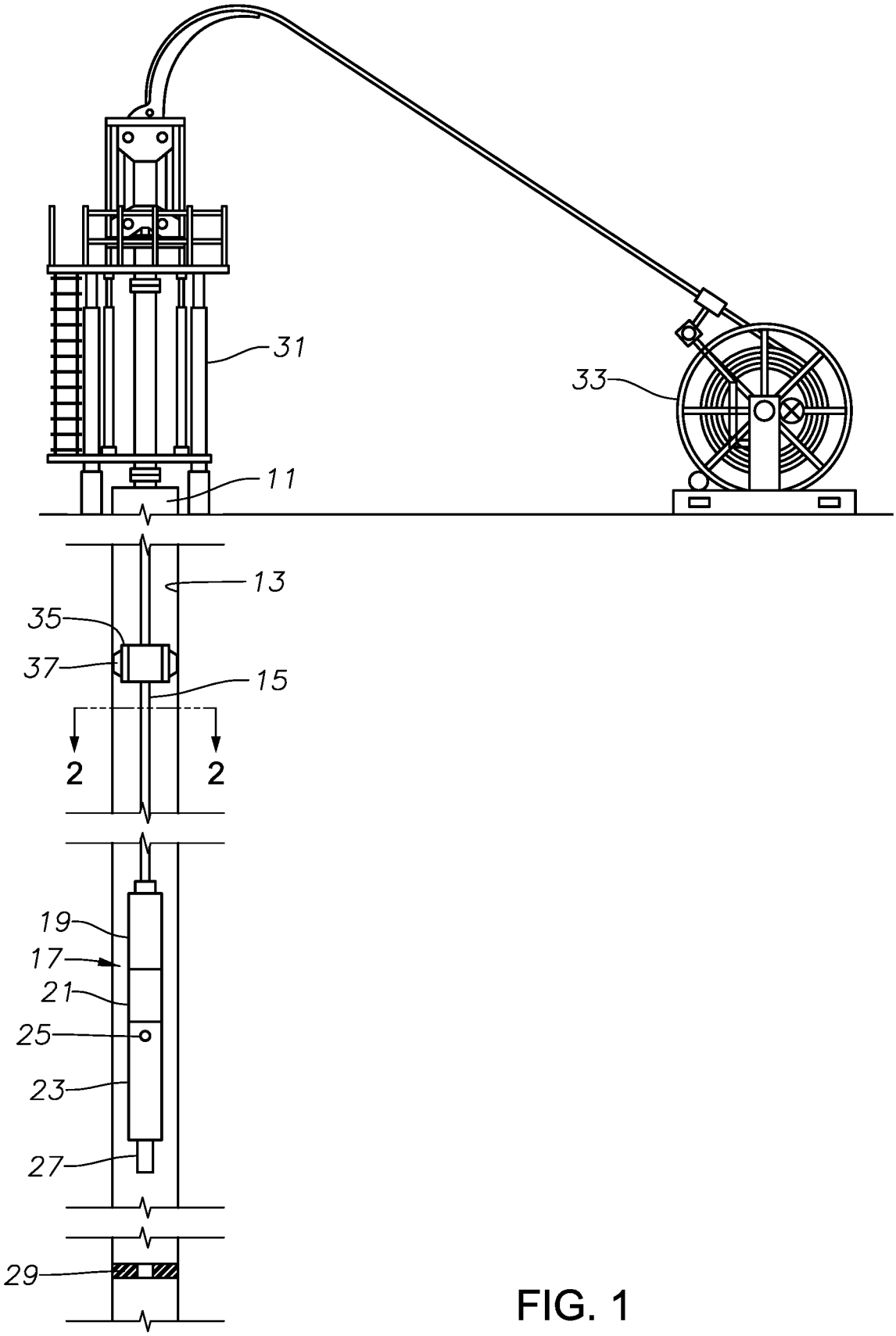
FIG. 1 is a schematic view of a load transfer device in accordance with this disclosure secured to power cable coiled tubing and in frictional engagement with a well tubing wall while deploying an electrical submersible pump.

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Referring to FIG. 1, a well has a wellhead or production tree 11 at the upper end that supports a string of production tubing or conduit 13 within a string of casing (not shown) cemented in the well. FIG. 1 illustrates a string of power cable coiled tubing 15 being lowered into production tubing 13. The lower end of power cable coiled tubing 15 supplies power to and supports downhole equipment that may be an electrical submersible pump (ESP) 17.

In this example, ESP 17 has an electrical motor 19 on the upper end. A seal section 21 connects to the lower end of motor 19 and has a pressure equalizer to reduce a pressure differential between lubricant in motor 19 and well fluid on the exterior. A pump 23 secures to the lower end of seal section 21. Pump 23 may be a centrifugal pump with a large number of stages, each stage having an impeller and a diffuser. Pump 23 has a discharge 25 on its upper end that discharges well fluid into an annulus surrounding seal section 21 and motor 19 within production tubing 13. Pump 23 has an intake tube 27 on its lower end that will extend into a previously set packer 29 for drawing in well fluid after ESP 17 lands on packer 29. Optionally, packer 29 could be lowered along with ESP 17, then set. Other configurations and types of ESP 17 are feasible.

Power cable coiled tubing 15 connects to the upper end of motor 19 and supports ESP 17 within production tubing 13 while ESP 17 is being lowered into production tubing 13. The terms "lower", "upper" and the like are used only for convenience because ESP 17 may be operated in other orientations, including horizontal. Power cable coiled tubing 15 extends upward through a coiled tubing injector 31, which is used to deploy power cable coiled tubing 15 into production tubing 13. Power cable coiled tubing 15 extends through coiled tubing injector 31 to a large reel 33, which was used to transport power cable coiled tubing 15 to the well site. Once power cable coiled tubing 15 and ESP 17 are installed, coiled tubing injector 31 and reel 33 may be removed from the well site.

The weight of ESP 17 and power cable coiled tubing 15 result in a limit in the depth a single, continuous length of power cable coiled tubing 15 may be deployed. As an example only, a length greater than 10,000 feet in the well could cause power cable coiled tubing 15 to part. Some wells may be considerably deeper, such as 14,000 feet or more. In this first embodiment, to avoid parting, technicians will secure a load transfer device 35 to power cable coiled tubing 15 after ESP 17 has reached a safe, selected depth, such as 7,000 feet. Load transfer device 35 has a gripping member, such as tracks 37 that grip the interior wall surface of production tubing 13.

In the first embodiment, tracks 37 will rotate, causing load transfer device 35 to move down production tubing 13 along with power cable coiled tubing 15. Tracks 37 have a resistance to rotation that continuously transfers a portion of the weight of power cable coiled tubing 15 below load transfer device 35 to production tubing 13 during the downward movement. Thus, after load transfer device 35 is secured to power cable coiled tubing 15, it will move downward with power cable coiled tubing 15. For example, tracks 37 may have a resistance set to rotate and allow downward movement only if the downward load imposed on load transfer device 35 equals the weight of 7000 feet of power cable coiled tubing 15 plus the weight of ESP 17. This load, which would in this example be substantially all of the load on power cable coiled tubing 15 at the load transfer device, will transfer through tracks 37 to production tubing 13. The portion of power cable coiled tubing 15 below load transfer device 35 will experience the load being transferred, but that load will be constant and below a selected maximum allowable until and after ESP 17 reaches packer 29.

The power cable coiled tubing 15 above load transfer device 35 will not experience any of the load transferred by load transfer device 35 to production tubing 13, both while lowering ESP 17 and after ESP 17 lands on packer 29. Rather, any given point along the length of the upper portion of power cable coiled tubing 15 will experience only a load based on how far that point is above load transfer device 35. The load on power cable coiled tubing 15 a few inches above load transfer device 35 will be only the amount, if any, of the load from below that load transfer device 35 does not transfer. For example, if load transfer device 35 transferred all of the load from the weight of power cable coiled tubing 15 suspended below it, including ESP 17, the load experienced by a point an inch above load transfer device 35 is substantially zero. When load transfer device 35 has been lowered along with power cable coiled tubing 15 several thousand feet, the load experienced at a point on power cable coiled tubing 15 near wellhead 11 will equal the weight of the power cable coiled tubing 15 from that point down to load transfer device 35. As long as the length of power cable coiled tubing 15 above load transfer device 35 does not exceed the maximum permissible length, the operator may deploy ESP 17 thousands of feet deeper than previously possible.

After ESP 17 lands on packer 29, load transfer device 35 will continue to transfer substantially the same load to production tubing 13. The operator will secure an upper end of power cable coiled tubing 15 to wellhead 11 and remove coiled tubing injector 31 and reel 33. The continued transfer of load by load transfer device 35 after coiled tubing injector 31 has been removed avoids any increase in load in power cable coiled tubing 17 below load transfer device 35 from reaching a parting level.

Figure 2:
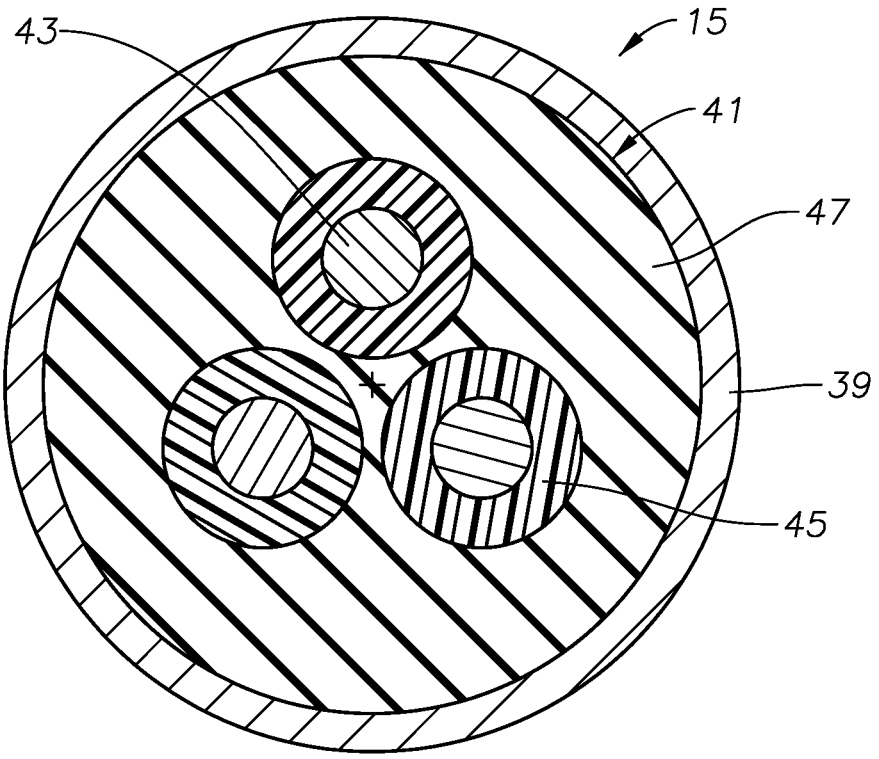
FIG. 2 is a transverse sectional view of the power cable coiled tubing of FIG. 1, taken along the line 2-2 of FIG. 1.

Referring to FIG. 2, power cable coiled tubing 15 includes a continuous length of coiled tubing 39 and an electrical power cable 41. Coiled tubing 39 is a steel tube that has a capability of being wound around reel 33 (FIG. 1) when out of the well. Coiled tubing 39 contains electrical power cable 41 for supplying three-phase electrical power to motor 19 (FIG. 1). Power cable 41 has three power conductors 43 that are arranged 120 degrees apart from each other relative to a centerline of power cable coiled tubing 15. Each power conductor 43 is encased in one or more separate electrical insulation layers 45. Also, the three power conductors 43 and their insulation layers 45 may be embedded within an elastomeric jacket 47, which is extruded over power conductors 43. One or more capillary tubes (not shown) could also be embedded within jacket 47 for supplying fluid downhole.

The exterior of jacket 47 is cylindrical and optionally may have a helical wrap of a metal strip of armor (not shown) surrounding it. Power cable 41 may be installed in coiled tubing 39 while coiled tubing 39 is being rolled into a cylindrical shape and seam welded. Alternately, power cable 41 may be pulled into coiled tubing 39 after coiled tubing 39 has been manufactured. Power cable 41 normally lacks the ability to support its own weight in a well, thus various arrangements may be made to frictionally transfer the weight of power cable 41 to coiled tubing 39 along the length of coiled tubing 39.

Figure 3:
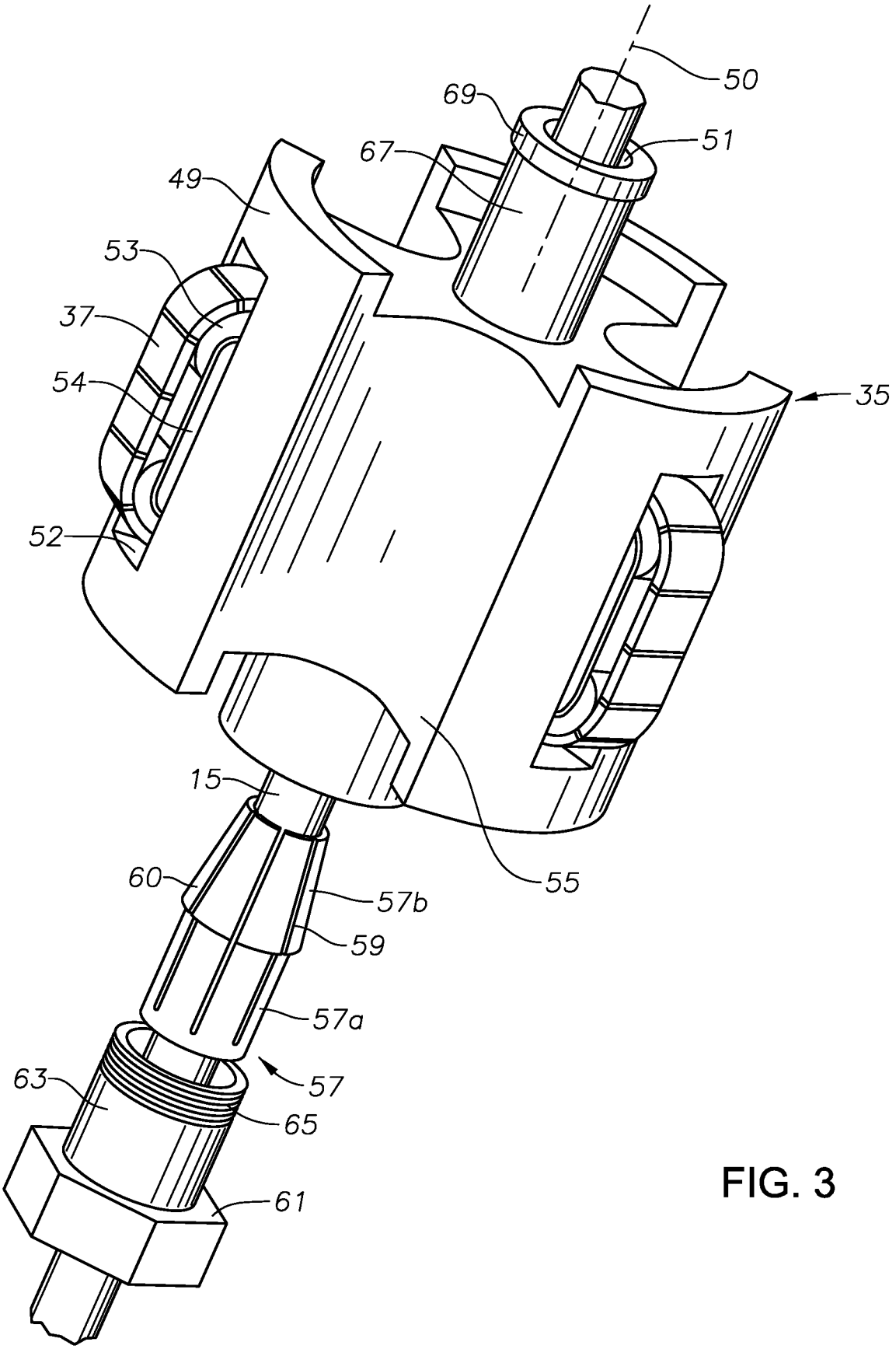
FIG. 3 is an isometric and partly exploded view of the load transfer device of FIG. 1.

Referring to FIG. 3, load transfer device 35 has a body 49 with a longitudinal axis 50. A bore or passage 51 extends coaxially from the lower end to the upper end of body 49. Tracks 37, shown schematically, may be elongated, parallel with axis 50, and equally spaced circumferentially apart from each other around the circumference of body 49. This example includes three tracks 37, but the number could vary. Each track 37 may comprise a rotating belt looped around rollers 53, analogous to a track of a bulldozer. The elongated outer side of each track 37 may have a tread or texture to enhance frictional gripping of the inner surface of production tubing 13 (FIG. 1). Each track 37 is located partly in a slot 52 in the exterior of body 49 and protrudes outward from body 49.

A brake 54, schematically illustrated, controls the amount of force or load required to rotate each track 37. For example, brake 54 could be a mechanical device that is pre-set to apply a selected resistance to the rotation of rollers 53. Brake 54 may include a brake pad and disc or drum. Rather than pre-set, brake 54 could be hydraulically actuated and supplied with hydraulic fluid pressure applied through a capillary tube (not shown) from the surface to load transfer device 35. The capillary tube could be deployed alongside power cable coiled tubing 15 while coiled tubing injector 31 is lowering power cable coiled tubing 15 (FIG. 1).

Body 49 has continuously open well fluid passages, which in this example, comprise open channels 55 on the exterior of body 49. Each channel 55 is located between two of the tracks 37.

In this example, a clamping arrangement to secure body 49 to power cable coiled tubing 15 comprises a collet 57. Collet 57 may be a single piece, as shown, or it may comprise two halves that are placed around power cable coiled tubing 15 when a selected length of power cable coiled tubing 15 has been lowered into production tubing 13. Collet 57 has a lower cylindrical portion 57*a* and an upper conical portion 57*b*. Axially extending slits 59 extend from near the lower end of cylindrical portion 57*a* through the upper end of conical portion 57*b*. Slits 59 define fingers 60 that will deflect inward.

A compression nut 61 has polygonal wrench flats and an upper sleeve 63 that has external threads 65. Collet cylindrical portion 57*a* slides into a cylindrical receptacle in compression nut sleeve 63. Collet conical portion 57*b* protrudes above compression nut 61 for reception within into a mating conical surface (not shown) in body bore 51. The lower end of bore 51 has threads (not shown) engaged by compression nut threads 65. Tightening compression nut 61 to the threads in bore 51 causes fingers 60 to deflect inward and tightly grip the exterior of power cable coiled tubing 15.

Body 49 may have a neck 67 that is coaxial and located on the upper end of body 49. Neck 67 may have an external flange or collar 69 on its upper end. If needed, a fishing tool (not shown) could be lowered on a retrieving string over power cable coiled tubing 15 into engagement with neck 67 to retrieve load transfer device 35.

During installation, an operator will attach ESP 17 to a lower end of power cable coiled tubing 15. The operator slides an upper end of power cable coiled tubing 15 through compression nut 61, collet 57 and body 49, but initially does not secure compression nut 61 to body 49. The operator then lowers ESP 17 into production tubing 13. While lowering ESP 17, compression nut 61, collet 57 and body 49 remain on the surface at the upper end of the well, allowing power cable coiled tubing 15 to slide through them.

Technicians secure compression nut 61 and collet 57 to power cable coiled tubing 15 once ESP 17 reaches a selected distance below wellhead 11 that is less than the maximum length for power cable coiled tubing 15 without risk of it parting. The technicians insert load transfer device 35 into production tubing 13 with tracks 37 gripping the inner side of production tubing 13. The operator operates coiled tubing injector 31 to continue lowering ESP 17 with load transfer device 35 moving in unison with power cable coiled tubing 15. As discussed above, tracks 37 of load transfer device 35 grip and roll down production tubing 13, transferring a portion of the weight suspended from body 49 to production tubing 13. Tracks 37 will continue to grip production tubing 13 after ESP 17 has landed on packer 29, transferring a portion of the load, which could be all of the load, existing on power cable coiled tubing 15 at the point where collet 57 grips it.

Figure 4:
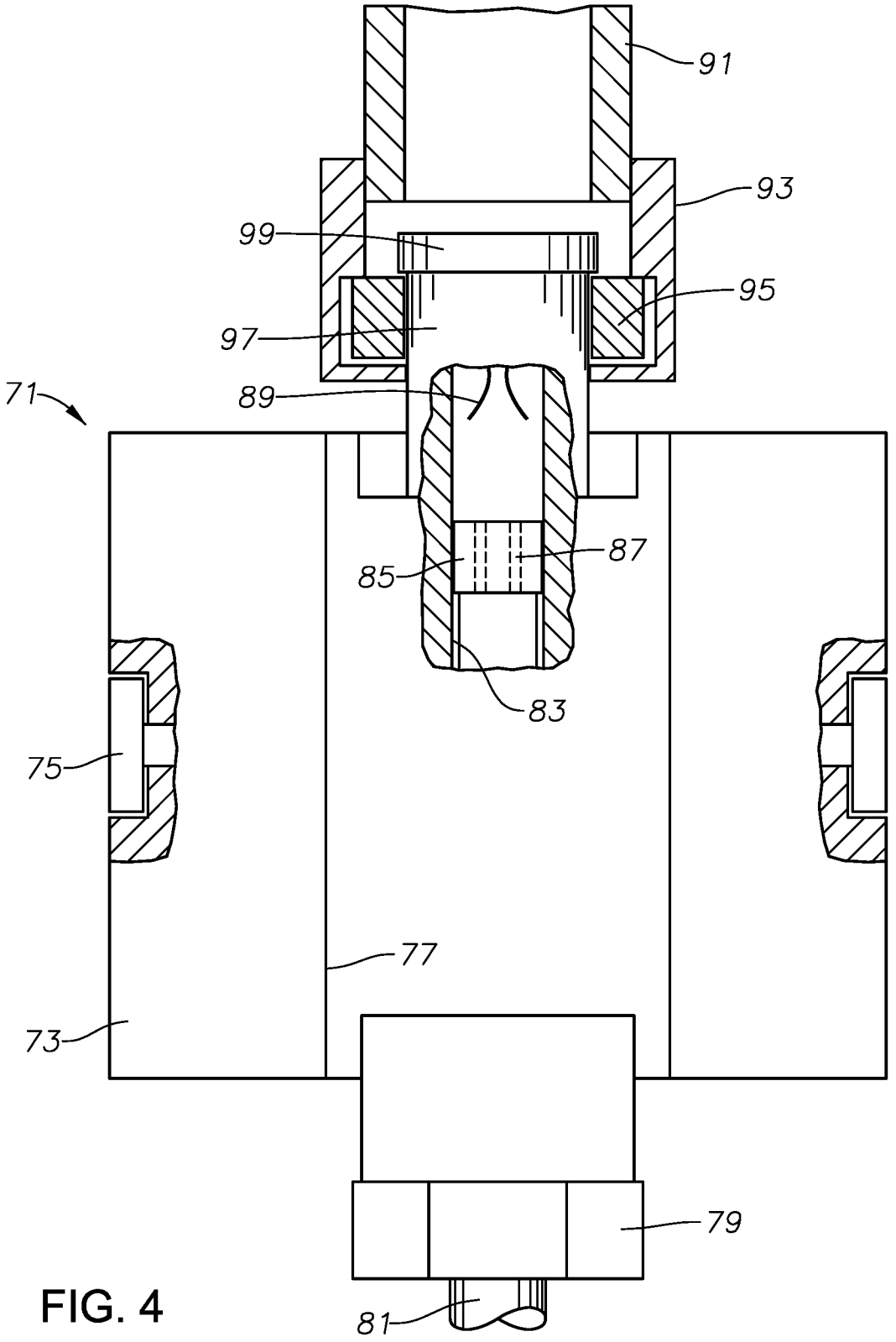
FIG. 4 is a partial sectional view of a second embodiment of a load transfer device in accordance with this disclosure, showing a lower power cable coiled tubing segment being run-in with a coiled tubing running string.

Referring to FIG. 4, in the second embodiment, load transfer device 71 does not engage the inner side wall of production tubing 13 continuously as it is being lowered; rather it transfers load to production tubing 13 only after ESP 17 (FIG. 1) lands on packer 29. Load transfer device 71 has a body 73 containing a plurality of pads 75 spaced around its circumference. Actuators (not shown) will move pads 75 out from the retracted position in FIG. 4 to the extended position in FIG. 5. In the extended position, pads 75 will frictionally and statically engage the inner surface of production tubing 13 (FIG. 1). The actuators could be a variety of devices, such as hydraulically powered pistons supplied with hydraulic fluid pressure from a capillary tube extending from the surface down to body 73.

Body 73 has vertical well fluid channels 77 to continuously allow the passage of well fluid past load transfer device 71. A compression nut 79, when tightened, causes a collet (not shown) that may be the same as collet 57 (FIG. 3), to tightly secure body 73 to a lower length or segment of power cable coiled tubing 81. Lower power cable coiled tubing segment 81 supports ESP 17 (FIG. 1). The length of lower power cable coiled tubing segment 81 is selected to be less than a length that could cause parting as a result of the load.

Lower power cable coiled tubing segment 81 extends upward into an axial bore 83 within body 73. While securing load transfer device 71 to lower power cable coiled tubing segment 81, a technician will sever an upper end of lower power cable coiled tubing segment 81 and attach a lower wet mate connector 85. Lower wet mate connector 85 has electrical contacts 87 and is shown only schematically. Lower wet mate connector 85 would have provisions to prevent electrical contacts 87 from being immersed in well fluid. Bore 83 may also have an orienting device 89, such as curved grooves or ribs.

In this embodiment, a coiled tubing running string 91 is employed to run lower power cable coiled tubing segment 81 and ESP 17 (FIG. 1). Coiled tubing running string 91 does not need to have a power cable within it. Coiled tubing running string 91 has more tensile strength than lower power cable coiled tubing segment 81 and may be larger in wall thickness and inner and outer diameters. A running tool 93 secured to the lower end of coiled tubing running string 91 has components, such as cam members 95, for releasably engaging neck 97 of load transfer device 71 below flange 99. Cam members 95 may be actuated in various manners, including hydraulic power supplied by a capillary tube (not shown) extending down to running tool 93.

Coiled tubing running string 91 will have the tensile strength to run lower power cable coiled tubing segment 81 and ESP 17 to the desired depth. During running, lower power cable coiled tubing segment 81 will experience the load of its weight plus ESP 17. Power cable running string 91 will experience the entire weight of lower power cable coiled tubing segment 81 and ESP 17, plus its own weight. The tensile strength of power cable running string 91 is sufficient to deploy several thousand feet of lower power cable coiled tubing segment 81.

When ESP 17 reaches packer 29 (FIG. 1), the operator actuates pads 75 of load transfer device 71 to grip the inner surface of production tubing 13 (FIG. 1). Load transfer device 71 will now transfer the weight of lower power cable coiled tubing segment 81 to production tubing 13. As an example, at this point, load transfer device 71 may be 7000 feet above ESP 17 and 7000 feet below wellhead 11. The operator then releases running tool 93 from load transfer device 71 and retrieves coiled tubing running string 91.

Figure 5:
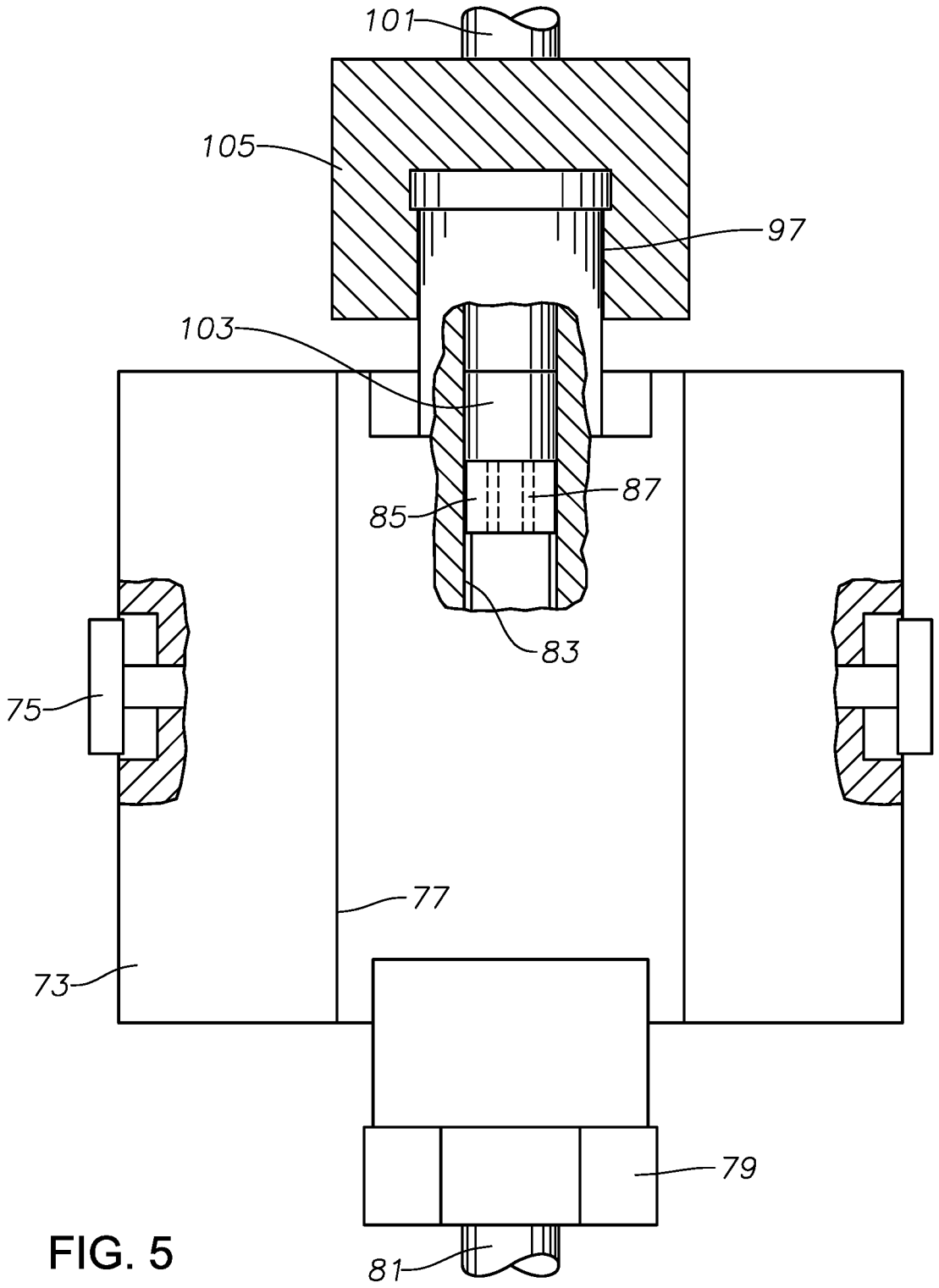
FIG. 5 is a partial sectional view of the load transfer device of FIG. 4 in a position for frictional engagement with the production tubing after reaching total depth, and showing an upper power cable coiled tubing segment stabbed into wet mate engagement with the lower power cable coiled tubing segment.

Referring to FIG. 5, the operator will then lower into production tubing 13 an upper power cable coiled tubing segment 101. Upper power cable coiled tubing segment 101 may be the same diameter and tensile strength as lower power cable coiled tubing segment 81. Upper power cable coiled tubing segment 101 has on its lower end an upper wet mate connector 103 (schematically shown) with electrical contacts (not shown) that are connected to the conductors in the power cable of upper power cable segment 101. As upper wet mate connector 103 nears lower wet mate connector 85, orienting device 89 (FIG. 4) will rotate upper wet mate connector 103 an increment to align the contacts of upper wet mate connector 103 with lower wet mate contacts 87. The electrical contacts of upper wet mate connector 103 will stab into engagement with contacts 87 of lower wet mate connector 85. A load transfer device connector 105 on the lower end of upper power cable coiled tubing segment 101 will engage and secure to neck 97.

The present disclosure described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

The invention claimed is:

1. A method for installing an electrical submersible pump (ESP) in a well containing a production conduit, comprising the following steps:

(a) securing the ESP to a lower end of a coiled tubing segment containing an electrical power cable;

(b) securing a load transfer device with a gripping member to the coiled tubing segment above the ESP;

(c) lowering the coiled tubing segment into the well along with the ESP and the load transfer device;

(d) contacting an interior side wall of the production conduit with the gripping member and transferring a load on the coiled tubing segment to the production conduit;

(e) powering the ESP to cause well fluid to flow upward from the ESP through the load transfer device and up the production conduit;

wherein step (d) comprises:

allowing the gripping member to roll along the interior side wall of the production conduit while simultaneously lowering the coiled tubing segment, the ESP, and the load transfer device into the well; and applying a brake to the gripping member to impart a resistance to rolling.

2. The method according to claim 1, wherein:

step (b) comprises first lowering the ESP and the coiled tubing segment into the well to a first selected depth, then securing the load transfer device to the coiled tubing segment and continuing to lower the ESP and the coiled tubing segment to a final selected depth while applying the brake to the gripping member.

3. The method according to claim 1, wherein:

after step (d), the method further comprises securing an upper end of the coiled tubing segment to a wellhead at an upper end of the well.

4. A method for installing an electrical submersible pump (ESP) in a well containing a production conduit, comprising the following steps:

(a) securing the ESP to a lower end of a coiled tubing segment containing an electrical power cable;

(b) securing a load transfer device with a gripping member to the coiled tubing segment above the ESP;

(c) lowering the coiled tubing segment into the well along with the ESP and the load transfer device;

(d) contacting an interior side wall of the production conduit with the gripping member and transferring a load on the coiled tubing segment to the production conduit;

(e) powering the ESP to cause well fluid to flow upward from the ESP through the load transfer device and up the production conduit;

wherein:

the coiled tubing segment comprises a lower coiled tubing segment;

step (c) comprises securing a running string to the load transfer device and with the running string, lowering the lower coiled tubing segment, the ESP and the load transfer device;

step (d) comprises extending the gripping member into engagement with the interior side wall of the production conduit only after reaching a selected depth for the ESP; then, the method further comprises:

releasing the running string from the load transfer device and retrieving the running string; then running an upper coiled tubing segment with a power cable into the production conduit and electrically engaging power conductors in the upper coiled tubing segment with power conductors in the lower coiled tubing segment.

* * * * *